US006140640A

United States Patent [19]

Wittmer et al.

[11] Patent Number: 6,140,640

[45] Date of Patent: Oct. 31, 2000

[54] ELECTROSPRAY DEVICE

[75] Inventors: Douglas P. Wittmer, Upton; Joseph A. Jarrell, Newton Highlands, both of Mass.

[73] Assignee: Water Investments Limited

[21] Appl. No.: 09/257,871

[22] Filed: Feb. 25, 1999

[51] Int. Cl.[7] ..... H01J 49/10

[52] U.S. Cl. ..... 250/288

[58] Field of Search ..... 250/288, 288 A, 250/281, 282

[56] References Cited

U.S. PATENT DOCUMENTS

| | | | |
|---|---|---|---|
| 3,652,248 | 3/1972 | Loxley et al. . | |
| 3,887,221 | 6/1975 | Young . | |
| 4,025,327 | 5/1977 | Harris . | |
| 4,529,230 | 7/1985 | Fatula, Jr. . | |
| 4,706,256 | 11/1987 | Sheng et al. . | |
| 4,787,656 | 11/1988 | Ryder . | |
| 4,877,270 | 10/1989 | Phillips . | |
| 4,908,116 | 3/1990 | Zare et al. | 204/299 R |
| 4,989,974 | 2/1991 | Anton et al. . | |
| 5,223,226 | 6/1993 | Wittmer et al. . | |
| 5,288,113 | 2/1994 | Silvis et al. . | |
| 5,395,521 | 3/1995 | Jagadeeswaran . | |
| 5,423,513 | 6/1995 | Chervet et al. . | |
| 5,487,569 | 1/1996 | Silvis et al. . | |
| 5,540,464 | 7/1996 | Picha . | |
| 5,572,023 | 11/1996 | Caprioli . | |
| 5,744,100 | 4/1998 | Krstanovic . | |

FOREIGN PATENT DOCUMENTS

| | | |
|---|---|---|
| 63-29377 | 6/1987 | Japan . |

OTHER PUBLICATIONS

Authors: Per E. Andren and Richard M. Caprioli Titled: In Vivo Release and Metabolism of Neurotensin in Rat Brain by Microdialysis and Nano–LC/Micro–ES/MS Conference: 42$^{nd}$ ASMS Conference on Mass Spectrometry –p. 347.

Authors: Mark R. Emmett and Richard M. Caprioli Titled: Release of Endogenous Methionine Enkephallin in Brain Using Microdialysis and Capillary LC, Micro–ES/MS/MS Conference: 42$^{nd}$ ASMS Conference on Mass Spectrometry –p. 420.

Authors: Richard M. Capriloli, Mark E. Emmett and Per E. Andren Titled: Micro–Electrospray: Ultra–High Sensitivity For Peptides (Zeptomoles/Attomoles) and Proteins (Attomoles/Femtomoles) Conference: 42$^{nd}$ ASMS Conference on Mass Spectrometry –p. 754.

Authors: Mark R. Emmett and Richard M. Caprioli Titled: Micro–Electrospray Mass Spectrometry: Ultra–High–Sensitivity Analysis of Peptides and Proteins Article: Journal Am Soc Mass Spectrom 1994, 5, 605–613.

Authors: Per E. Andren, Mark R. Emmett and Richard M. Caprioli Titled: Micro–Electrospray: Zeptomol/Attomole Per Microliter Sensitivity For Peptides Article: J. Am Soc Mass Spectrom 1994, 5, 867–869.

Authors: Mark Ralph Emmett Titled: Development of Micro–Electrospray Mass Spectrometry for Ultra High Sensitivity and Application in the Study of Drugs of Abuse on Endogenous [Met]$^5$–Enkephalin Release Dissertation: 1995, Presented to the Faculty of the University of Texas at Houston Graduate School of Biomedical Sciences.

*Primary Examiner*—Kiet T. Nguyen

*Attorney, Agent, or Firm*—Brian Michaelis; Anthony J. Janiuk

[57] ABSTRACT

A non-reactive electrospray needle structure that can be used with relatively low electrical potential introduced externally at a selectable location along the length of the needle structure. The electrospray device or apparatus includes a non-conductive tube with an inner diameter, with one end of the tube having a reduced inner diameter thereby forming a tip. The tube is configured to have a fracture in it, positioned a predetermined or selectable distance from the tip. An electrically conductive path, such as a wire or electrode, is provided external to the tube and proximate to the fracture. A collar surrounds the tube proximate the fracture. The electrically conductive path provides a voltage potential to charge the spray. The collar maintains the conductive path in place, seals the tube at the fracture, and provides structural strength. In one embodiment, the tube is packed with a binding material to form a column bed.

14 Claims, 5 Drawing Sheets

ELECTROSPRAY DEVICE

FIELD OF THE INVENTION

This invention is concerned with analytical chemistry equipment, and more specifically to capillary columns and electrospray devices for mass spectrometry.

BACKGROUND

A liquid flowing through a capillary jet or orifice may be converted into a spray of small charged droplets (on the order of I micrometer in diameter) by applying an electric field to the liquid as it emerges from the tip of the capillary. For a sufficiently high applied electric field, the electrostatic stress imposed by the field and the surface-induced electric charge is sufficient to overcome the surface tension forces on the liquid. The liquid breaks apart into small charged droplets. This process of forming a spray is known as electrospray.

Electrospray is widely used for analysis of sample solutions. For example a sample solution such as a liquid stream effluent from a liquid chromatography (LC) separation step is atomized by an electrospray device and analyzed with a mass analyzers such as a quadrupole mass spectrometer, an ion trap mass spectrometer, a time-of-flight mass spectrometer, or a magnetic sector mass spectrometer. Electrospray ionization mass spectrometry is also widely used for the analysis of biological molecules, including peptides and proteins.

An example of a prior art electrospray apparatus is described in U.S. Pat. No. 5,572,023 issued to Caprioli. Caprioli describes an electrospray apparatus and method including an electrically charged capillary spray needle which may be filled with packing material forming a column bed. The packing material differentially adsorbs selected chemicals in the sample solution before it is discharged from the spray needle into the vaporizing and analysis chamber. Caprioli discloses charging the sample solution at an upstream location by passing it through a steel "zero dead-volume" fitting. The steel fitting is connected to a high voltage source, thereby imparting a charge to the sample solution. The charged solution then continues through tubing to the non-conductive spray needle and is discharged. This conductive fitting is located substantially upstream from the discharge end of the spray needle. As reduced to practice, the voltage source must always be placed upstream of the column bed.

A number of problems are caused by this setup. First is a requirement for excessive dead volume. "Dead volume," as used in Caprioli, is that volume outside the column bed through or into which the solution sample must flow or diffuse. Longer flow paths cause excess dead volume, thereby requiring more sample solution to fill the dead volume, and also results in bandspreading in a chromatographic analysis.

Caprioli addresses the issue of postcolumn dead volume, which leads to bandspreading, but ignores that of precolumn dead volume and holdup volume. Precolumn dead volume is the volume before the column bed, and holdup volume is the system volume between the point of gradient generation and the front of the column bed. Precolumn dead volume results in bandspreading, specifically when present in isocratic HPLC (High Performance Liquid Chromatography) methods. Excessive holdup volume, together with excessive precolumn dead volume, results in a longer run to run turnaround time, especially (but not exclusively) with gradient HPLC methods.

The electrical contact in Caprioli is upstream of the column bed. The transport tubing to the column is noncontinuous (severed) in order to provide electrical contact with the sample solution. This in turn necessitates the use of a leakproof joint capable of withstanding the high fluid pressure generated by the column bed. Such joints are troublesome, as shown in the embodiment. While Caprioli employs a conventional "zero dead volume" fitting, this term is unclear because the fitting clearly introduces dead volume. The means by which the two 50 micron ID (inside diameter) tube orifices are mated are not described specifically, but it is safe to assume that it was done in a conventional manner, using a PEEK sleeve, similar to the needle support. The OD (outside diameter) of the tubing used varies from 140 microns to 350 microns. This is well below the through hole of the fitting, specified at 0.5 mm (500 microns). In any scenario, it is extremely difficult, if not impossible, to make a truly "zero" dead volume connection. The result is an unpredictable contribution to precolumn bandspreading.

Further, as disclosed in Caprioli, when the electrospray electrode is located significantly upstream of the needle tip and column bed, the electrical resistance between the electrode and the needle tip becomes significant, especially with smaller capillary inner diameters. This means that an excess potential must be maintained on the electrode relative to the resulting potential at the needle tip. Undesirable electrical arcing and corona discharge in the electrode region can occur.

Still further, in a given LC/ESI/MS system, if the electrode is moved further from the needle tip and upstream of the column, it is necessarily placed closer to the injector and pump. This in turn decreases the electrical resistance between the electrode and these system components, causing more electric current to flow to them. This presents one of two problems. If the component is not grounded it, like the electrospray tip, will float at some voltage less than that of the electrode, creating the operational and safety problems associated with the abrupt discharge of high voltage (arcing). If the component is grounded, a substantial current will flow through the component which may exceed the current limits of the power supply. The solution to this problem, as disclosed by Caprioli, is to increase the resistance between these components and the electrode by using longer lengths of tubing between the pump and injector, and/or between the injector and electrode. This extra tubing results in a cumulative increase in holdup volume and/or precolumn dead volume, as previously discussed. Again, this implies more bandspreading in the case of isocratic operation, and longer turnaround times in the case of gradient operation.

Still another problem known in the art is presented by the metallic electrodes commonly employed internal to electrospray sources. It has been observed that electrochemically active compounds may react at the surface of some metallic electrodes. In the case of electrospray mass spectrometry, this results in a decrease in ion intensity for the target compound and/or the appearance of ions produced from the products of the oxidized or reduced target compound. Additionally, components of the mobile phase may form ionic complexes with metallic components of the electrode. Such organometallic complexes then interfere with mass spectral measurements. If the electrode is placed between the injector and the column, for example by the use of a metallic fitting, compounds swept across the surface of the electrode are subject to such interactions.

SUMMARY

The present invention provides a non-reactive electrospray needle structure that can be used with relatively low electrical potential introduced externally at a selectable location along the length of the needle structure.

According to the invention, an electrospray device or apparatus includes a non-conductive tube with an inner diameter, with one end of the tube having a reduced inner diameter thereby forming a tip. The tube is configured to have a fracture in it, positioned a predetermined or selectable distance from the tip. An electrically conductive path, such as a wire or electrode, is provided proximate to the fracture. A collar surrounds the tube proximate the fracture. The electrically conductive path provides a voltage potential to charge the spray. The collar maintains the conductive path in place, seals the tube at the fracture, and provides structural strength.

In one embodiment, the tube is packed with a binding material to form a column bed. This binding material allows the tube to work as an HPLC column, for example using Symmetry®spherical C18 available from Waters Corporation, Milford, Mass.

The present invention can be used with any of various electrospray systems, whereby a sample solution or solvent passes through the tube. A power supply connected to the electrically conductive path provides an electric field at the location of the fracture. Sample solution passing the location of the fracture proceeds to the tip and disperses as charged droplets or electrospray. These droplets are then available to be analyzed by any of various analytical instruments.

Advantages of the present invention include lower voltage requirements and added safety. By placing the electrode closer to the tube tip, electrical resistance is decreased, thereby decreasing the minimum voltage required to induce electrospray. This decreases the chance of arcs and corona discharge in the electrode region.

Another advantage of the present invention is less exposure of the electrode to solvent. By making contact across a fracture, the proportion of solvent exposed to the electrode surface is limited by diffusion, largely reducing solvent and/or sample interactions with the electrode surface. Diffusion and subsequent interaction is in turn further reduced when the fracture is placed within the column bed (the packed binding material).

Another advantage of the present invention is the reduction in dead volume within the sampling system. The fracture in the tube device is created after fabricating a mechanical backbone, the purpose of which is to maintain alignment of the resulting tube segments, with negligible dead volume. The fracture may be placed at the posterior section of the column bed, in which case the joint need not seal to such high pressures, rendering it easier and less expensive to fabricate.

Still another advantage of the present invention is reduced bandspreading. Placing the electrode closer to the tip and within the column maximizes resistance between the electrode and the pump and injector components, allowing for minimal transport tubing in the system, thereby minimizing isocratic bandspreading and gradient turnaround time. Safety is also increased, since pump and injector components are isolated and less likely to float at a voltage level. Lesser potentials can be used to charge the electrospray thereby minimizing the possibility of arcing.

Still another advantage of the present invention is an electrospray needle with or without a packed bed that is low cost and easy to manufacture, and provides a consistent performance during sample analysis.

BRIEF DESCRIPTION OF THE DRAWINGS

The foregoing and other features and advantages of the present invention will be more fully understood from the following detailed description of illustrative embodiments, taken in conjunction with the accompanying drawings in which.

DETAILED DESCRIPTION

The present invention is directed towards an electrospray device or needle including a non-conductive outer wall with a conducting channel passing from the inner volume out to a conducting wire for providing an electric potential to the inner volume of the electrospray needle.

Figure 1:
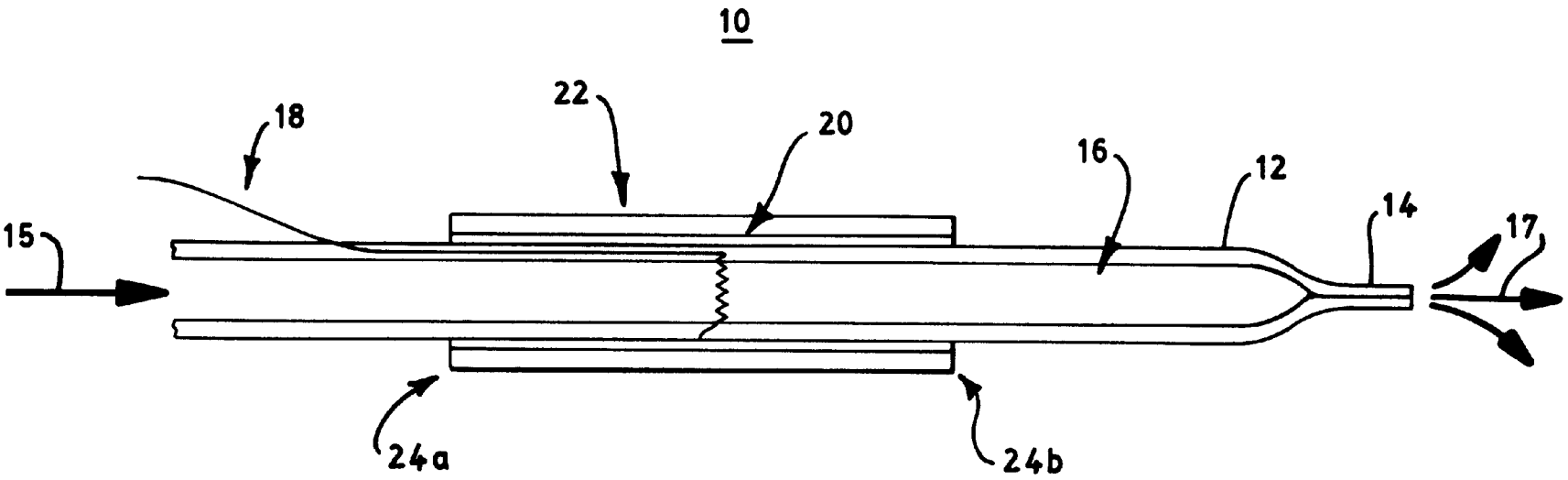
FIG. 1 is an illustrative embodiment of an electrospray device according to the present invention.

As shown in the illustrative embodiment 10 of FIG. 1, a non-conductive tube 12 is provided. The non-conductive tube 12 tapered at one end to form a tip 14. In use, sample solution is introduced in one end, as shown by arrow 15. The sample passes through the inner chamber 16 and out the tip 14 in a spray, as shown by arrow 17. An electrode or conductive wire 18 is positioned proximate a fracture 20 in the non-conductive tube 12. Through this fracture 20, the conductive wire 18 is exposed to the sample solution passing through the inner chamber 16. The conductive wire 18 provides an electrically conductive path to a power supply. The fracture 20 may be positioned at any location along the non-conductive tube 12 as desired. A collar 22 surrounds the non-conductive tube 12 around the fracture 20 to provide a seal and prevent leakage of the sample solution. The collar 22 also structurally strengthens the non-conductive tube 12. The collar 22 may be sealed to the non-conductive tube 12 using adhesive sealant at both ends 24*a* and 24*b*. The conductive wire 18 is positioned to reach the fracture 20, for example, by traveling along a side of non-conductive tube 12, under the collar 22 to reach the fracture 20.

In this illustrative embodiment, the non-conductive tube 12 is fabricated from fused silica. The fused silica tube for certain applications has in internal diameter of approximately 50 microns and an outside diameter of approximately 150 microns. It should be appreciated that tubes of other materials, e.g. quartz, polymeric materials such as PEEK or polypropylene, ceramic materials such as alumina or zirconia or the like, and other dimensions, can be used as a function of the intended application.

The non-conductive tube 12 is drawn using a glass puller to create the tip 14. The tip 14 is etched or sanded to the desired diameter of approximately 4–40 micrometers. The tube is scored for the purpose of creating the fracture 20 at the desired distance from the tip. The conductive wire 18 for the illustrative embodiment is a 0.002" stainless steel or platinum wire which is placed proximate to the scoring and positioned along the non-conductive tube 12. The collar 22 is a double wall teflon collar which is slid over the non-conductive tube 12, shrunk by heating, and sealed at both ends 24 using epoxy. The fracture is ultimately formed by applying stress on that portion of the tube which is scored. The stress source can be mechanical, i.e. by gently bending the collar, or thermal, i.e. by heating a center section of the non-conductive tube.

The electrospray device 10 is used in any of various electrospray systems. The electrospray device 10 is connected to flow tubing to receive the sample solution under pressure. The conductive wire 18 is connected to a power source to provide a voltage potential for the electric field.

Figure 2:
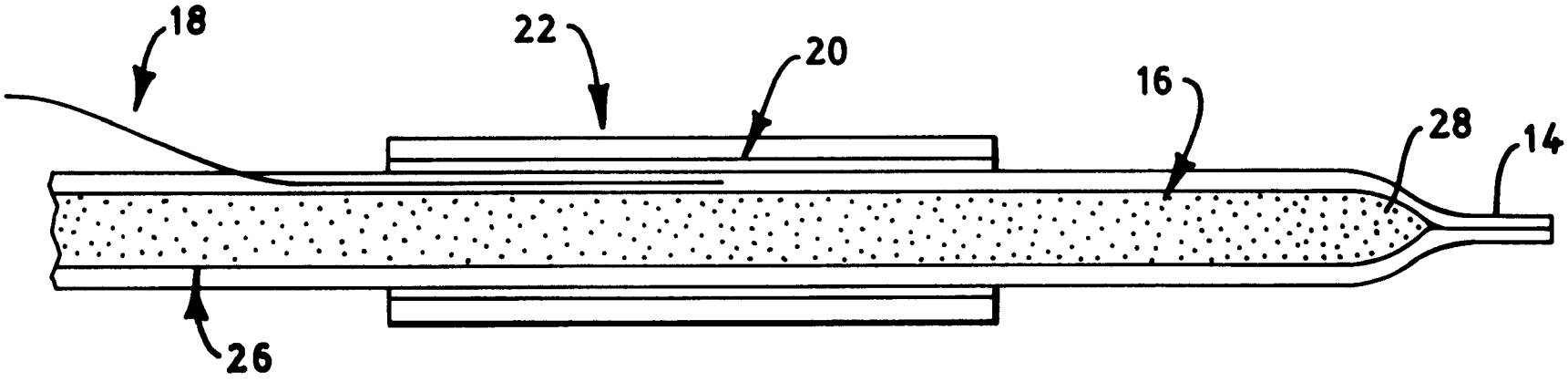
FIG. 2 is a packed electrospray device according to another embodiment of the present invention.

An alternative embodiment of the present invention is shown in FIG. 2. Here, the inner chamber 16 is packed with a binding material 26 forming a column bed to allow the electrospray device to work as an HPLC column. The sample solution passes through the binding material 16 and exits out the tip 14. The sample solution also is exposed to the electric field provided by the fracture 20 and conductive wire 18. The binding material 26 remains inside the inner chamber 16, and is prevented from extruding by the reduced diameter of tip 14. With an appropriately dimensioned tip no frit is needed to keep the binding material 26 in place, even under high pressure. However, a frit may be used if desired, and can be positioned inside the inner chamber 16 near the tip 14, as shown by frit 28.

For this embodiment, the binding material used is Symmetry spherical C18 available from Waters Corporation, Milford, Mass., which is slurry packed into the inner chamber 16. However, other binding materials may be used separately or in combination.

A feature of the embodiment of FIG. 2 is that the fracture 20 can be positioned at any point along the inner chamber 16. As shown in FIG. 2, the fracture 20 is approximately at the center of the packed binding material 26, whereby the electric field is strongest at the center of the packed binding material 26. However, the fracture 20 can be moved selectably either towards or away from the tip 14, thereby moving the voltage source to different areas of the packed binding material 26. This allows for selectively controlling and optimizing the HPLC performance for different applications.

Figure 3:
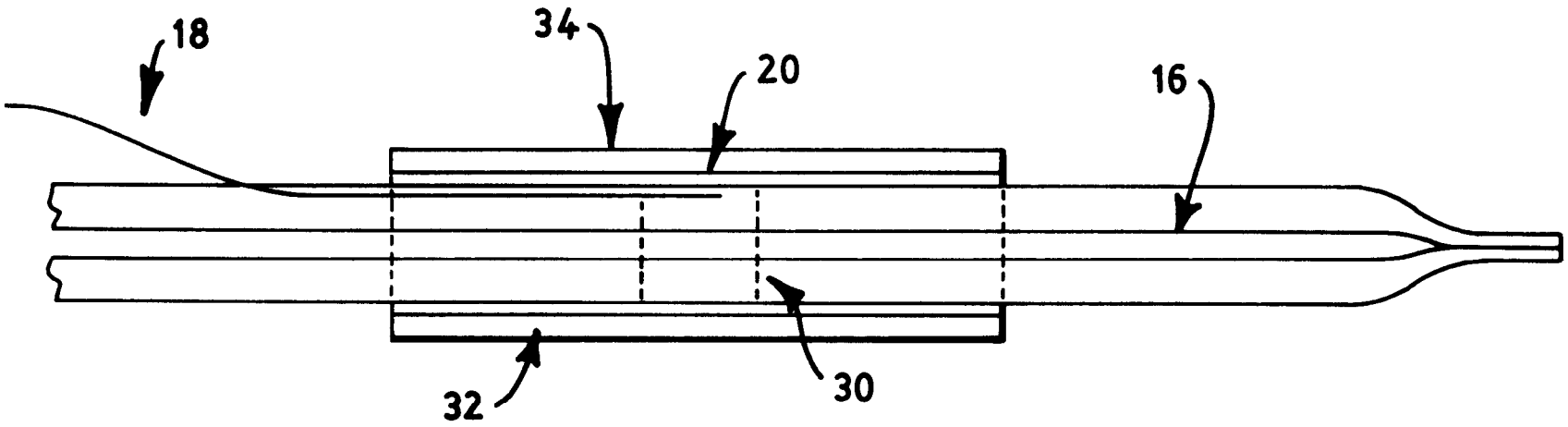
FIG. 3 is another embodiment of the present invention.

Another embodiment is shown in FIG. 3. The electrode or conductive wire 18 is contained within a narrow collar 30, formed for example by a small piece of shrink tubing. A longer piece of double wall tubing, with the inner wall 32 comprising a polymer having a lower melting point than the outer wall 34, is shrunk onto the entire assembly, forming an inner seal with an outer structural wall 34. As previously described, the inner chamber 16 may be packed with binding material if desired (not shown).

Figure 4:
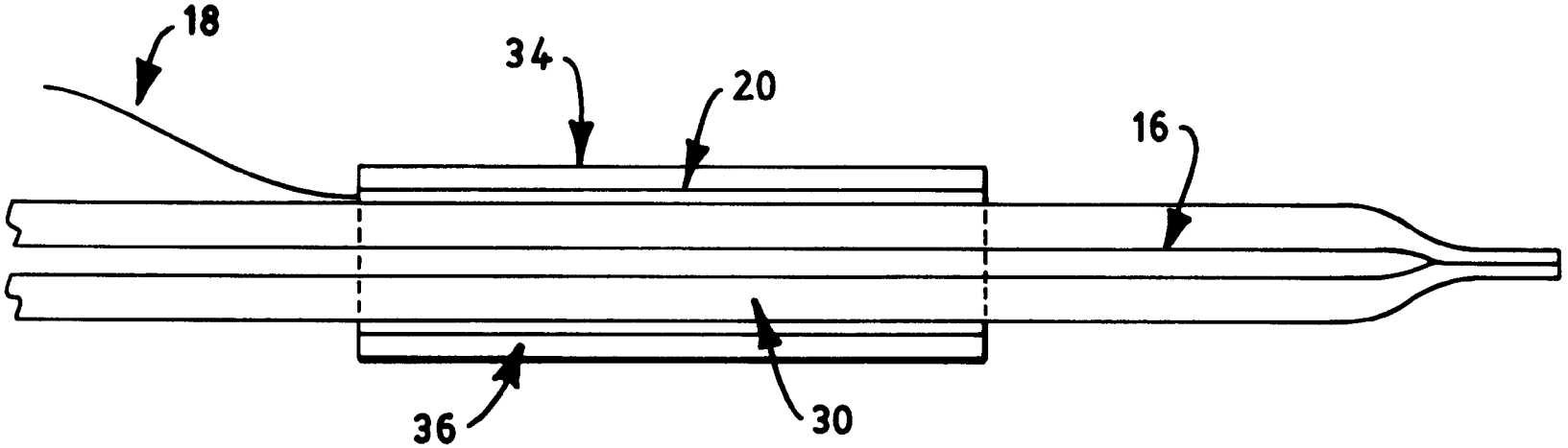
FIG. 4 is another embodiment of the present invention.

Another embodiment is shown in FIG. 4. Here, the inner seal is an inner conductive seal 32, with an outer non-conductive wall 34. The voltage potential is provide by the conductive wire 18 which is electrically connected to the inner conductive seal 32. The electric field is therefore provided along the length of the collar 22, and also at the fracture 20. The inner chamber 16 may be packed with binding material if desired (not shown).

Figure 5:
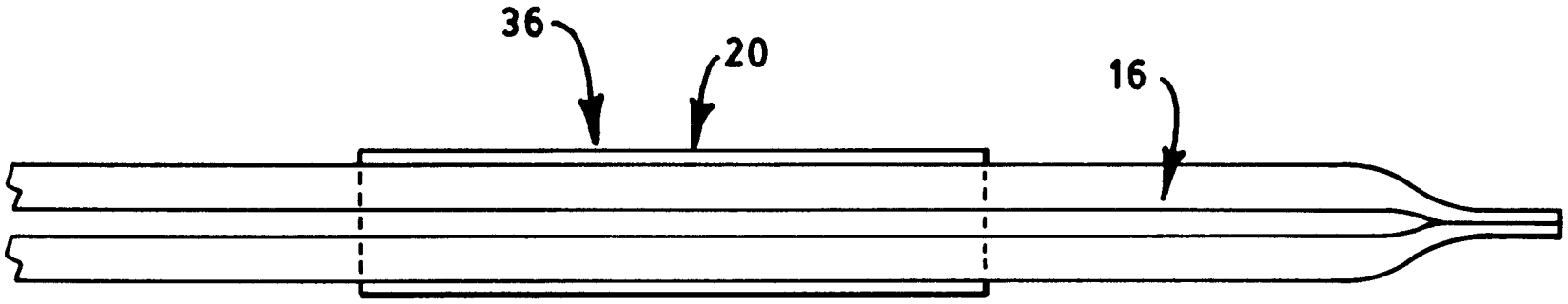
FIG. 5 is yet another embodiment of the present invention.

Still another embodiment is shown in FIG. 5. Here, the outer structural wall 36 is made of conductive material, and therefore functions as both the structural wall and as an electrode. The inner chamber 16 may be packed with binding material if desired (not shown).

The present invention may be used in any of various electrospray spectrometry systems including capillary scale LC-electrospray-mass spectrometry. A commercial example is the Micromass Platform LCZ. A typical sample solution pressure is 500–3000 psi, with an electric field voltage of 400–3000 volts. Other binding materials which may be used for the packed bed inside inner chamber 16 include those used for reverse phase, normal phase, ion exchange, or size exclusion modes of separation.

While the non-conductive tube or needle design described herein includes a reduced diameter at an end thereof, it should be appreciated that unpacked implementations can be of uniform ID, that is, without a reduced diameter end. Similarly, a uniform diameter tube could be implemented with a frit at an end thereof in order to produce a packed needle according to the invention.

Although the fracture 20 is formed in the illustrative embodiment herein by scoring the tube, it should be appreciated that other approaches can be effected to mechanically develop the fracture, such as by a sharp blow, or alternatively by thermal shock from heating a center section of the non-conductive tube 12 and quickly cooling it by a liquid bath or freezing spray. Laser ablation or grinding or other methods can also be used to form the fracture.

Although the invention has been shown and described with respect to illustrative embodiments thereof, various other changes, omissions and additions in the form and detail thereof may be made therein without departing from the spirit and scope of the invention.

What is claimed is:

1. An electrospray apparatus comprising:

a non-conductive tube with an inner diameter and a first end and a second end;

a fracture in said non-conductive tube, said fracture positioned a predetermined distance from one of said first end and said second end; and an electrically conductive path to said fracture on an exterior of said non-conductive tube.

2. The electrospray apparatus of claim 1 further including:

a collar surrounding said tube proximate said fracture.

3. The electrospray apparatus of claim 2, wherein said electrically conductive path includes a wire proximate said fracture and passing between said tube and said collar.

4. The electrospray apparatus of claim 1, wherein said non-conductive tube is packed with a binding material.

5. The electrospray apparatus of claim 4, wherein said fracture is positioned at a point on said non-conductive tube that is substantially at a center point of said packed binding material.

6. The electrospray apparatus of claim 3, wherein one of said first end and said second end includes a frit between said packed binding material and said end.

7. The electrospray apparatus of claim 1 wherein said non-conductive tube is fused silica.

8. The electrospray apparatus of claim 1 wherein one of said first end and said second end has a reduced inner diameter.

9. A method of making an electrospray apparatus comprising:

providing a non-conductive tube having an end;

fracturing said non-conductive tube at a predetermined position from said end; and positioning a wire proximate said fracture.

10. The method of claim 9 further including a step of positioning a collar over said fracture.

11. The method of claim 10 further including a step of sealing said collar to said non-conductive tube.

12. The method of claim 9 further including a step of packing said non-conductive tube with a binding material.

13. The method of claim 12 further including:

before said step of packing said non-conductive tube with a binding material, positioning a frit in said non-conductive tube and proximate said end.

14. The method of claim 9 wherein said step of providing said non-conductive tube having an end involves drawing an end of a non-conductive tube with an inner diameter to produce an end with a reduced inner diameter.

* * * * *